United States Patent [19]

Sheffer

[11] Patent Number: 4,541,781

[45] Date of Patent: Sep. 17, 1985

[54] PISTON PUMP HAVING INERTIAL ROLLERS MOUNTED FOR RADIAL MOVEMENT

[76] Inventor: Kenneth W. Sheffer, 817 East Ave., Baxter Springs, Kans. 66713

[21] Appl. No.: 570,023

[22] Filed: Jan. 11, 1984

[51] Int. Cl.[4] ..... F04B 19/00; F04B 1/04

[52] U.S. Cl. ..... 417/211; 417/273; 74/55

[58] Field of Search ..... 417/211, 271, 273, 328, 417/477, 521; 92/72, 58, 148; 74/55

[56] References Cited

U.S. PATENT DOCUMENTS

| | | | |
|---|---|---|---|
| 244,799 | 7/1881 | Dye | 92/71 |
| 493,263 | 3/1893 | Fogg | 417/273 |
| 580,714 | 4/1897 | Perine | 417/273 |
| 630,130 | 8/1889 | Stuth | 417/211 X |
| 646,030 | 3/1900 | McKinnon | 74/55 |
| 646,031 | 3/1900 | McKinnon | 417/273 |
| 717,445 | 12/1902 | Nestius | 74/55 X |
| 775,008 | 11/1904 | Kahler | 417/328 X |
| 1,914,141 | 6/1933 | Lundin | 417/273 |
| 2,022,620 | 11/1935 | Harper | 417/273 X |
| 2,319,718 | 5/1943 | Brooks | 417/273 |
| 2,341,196 | 2/1944 | Svenson | 417/273 X |
| 2,471,939 | 5/1949 | Davis | 417/273 |
| 2,663,264 | 12/1953 | Michalitsianos | 417/328 X |
| 2,928,353 | 3/1960 | Murray | 417/475 |
| 3,829,249 | 8/1974 | Pursley | 417/474 X |
| 3,945,763 | 3/1976 | Terhune | 417/211 |
| 4,210,138 | 7/1980 | Jess et al. | 417/477 X |
| 4,347,778 | 9/1982 | Murray | 417/475 X |

FOREIGN PATENT DOCUMENTS

| | | | |
|---|---|---|---|
| 2452771 | 5/1976 | Fed. Rep. of Germany | 417/477 |
| 2730632 | 1/1979 | Fed. Rep. of Germany | 417/273 |
| 179324 | 5/1922 | United Kingdom | 417/477 |

*Primary Examiner*—William L. Freeh
*Assistant Examiner*—Paul F. Neils
*Attorney, Agent, or Firm*—Wood, Herron & Evans

[57] ABSTRACT

A rotary fluid pump is disclosed which uses rotating rollers running along a circular track to successively depress a plurality of lever arms which in turn operate pistons in a like number of pumps to thereby pump a fluid. The rollers are free to rotate on a frame, which frame rotates co-axially within the track. The rollers are carried on sleeves which slide on arms extending from the hub of the frame, such that the rollers are free to move radially outwardly, as well as inwardly, in response to inertial (i.e., centrifugal) forces associated with the rotation of the frame.

9 Claims, 4 Drawing Figures

PISTON PUMP HAVING INERTIAL ROLLERS MOUNTED FOR RADIAL MOVEMENT

FIELD OF THE INVENTION

This invention generally relates to fluid pumps, such as air compressors and water pumps, and in particular relates to rotary pumps which use a rotating frame or rotor having rollers which drive lever arms which in turn drive pistons within pumps to effect pumping and/or compression of a fluid.

BACKGROUND OF THE INVENTION

Rotary pumps and like power-transmitting devices have been well known in the prior art. Such rotary pumps particularly relating to air compressors are shown in U.S. Pat. Nos. 2,319,718, 646,031, and 580,714. Such known pumps in general comprise a plurality of pneumatic or hydraulic pumps which radiate from a casing around a substantially circular line. Each of the pumps has a cylinder with a reciprocating piston therein, with a piston rod connected at one end to a lever arm. The other end of the lever arm is connected to the casing.

Mounted concentric with the casing is a rotor or rotor-like member which typically carries a number of rollers thereon. The rollers are rotatably mounted on the rotor-like element a fixed distance from the hub of the member. That is, the rollers do not have the ability to move radially inwardly or outwardly. The rollers thus follow a circular path of fixed radius as they are spun by the rotor-like element.

The lever arms are biased to extend within the outer radius of the circular path of the spinning rollers. As the rotor element turns, each of the rollers depresses the lever arms in succession, thereby driving the pistons within the pump cylinders to pump and/or compress a fluid medium.

It is an object of this invention to make an improved rotary pump of the foregoing type. It is a particular object of this invention to make such an improved rotary pump through utilization of the inertial forces developed in the orbiting rollers to thereby increase the overall efficiency of the pump.

SUMMARY OF THE INVENTION

The foregoing as well as other objects have been accomplished in this invention in a rotary pump which utilizes the inertial, or, more commonly, centrifugal, energy which is present in an orbiting body. To this end, a rotary pump utilizing centrifugal force has been developed. The rotary pump has a housing or casing which carries a plurality of pumps arranged in a generally sinuous pattern around and radiating from the casing, for example. Each pump has a cylinder, a reciprocating piston within the cylinder, an inlet admitting fluid into the cylinder, and an outlet for exhausting fluid from the chamber, and appropriate inlet and outlet valves to control fluid flow.

A circular track, which in a preferred form comprises a plurality of spaced apart circular track portions, is located within the casing. A plurality of lever arms are connected to respective pumps with the lever arms biased to extend within the radius of the track in a generally sinuous pattern substantially concentric therewith. That is, the lever arms extend between the aforementioned track portions in a staggered fashion. The track portions, lever arms and pumps may all advantageously be supported by the casing.

The rotary drive member forms the heart of the invention. The drive member has a rotatable frame with preferably a plurality of rollers rotatably carried on the frame and mounted for movement along the inside of the circular track.

Significantly, the rollers are carried on the frame in a manner permitting the rollers to move radially toward the lever arms. That is, as the frame of the drive member is rotated, the rollers are free to move radially outwardly with respect to the hub of the frame and toward the track and lever arms in response to inertial forces present in the orbiting rollers. In a presently preferred form of the invention, the rollers are carried on sleeves which slide on arms radiating from the hub of the frame to permit this radial movement.

The frame when rotated, as for instance by a drive from a conventional electric or gasoline powered motor, causes the rollers to run along the track and over the lever arms in succession to thereby drive the pistons of the pumps to effect pumping and/or compression of a fluid supplied to each of the cylinders. By permitting the rollers to move radially in the manner described, the efficiency of the rotary pump is theorized to be increased, since the inertial forces generated in the orbiting rollers can be put to work in depressing the lever arms.

The foregoing objectives, features and advantages of the present invention will be more readily understood upon consideration of the following detailed description of the invention taken in conjunction with the accompanying drawings in which:

DETAILED DESCRIPTION OF AN EMBODIMENT OF THE INVENTION

General Operation

Figure 1:
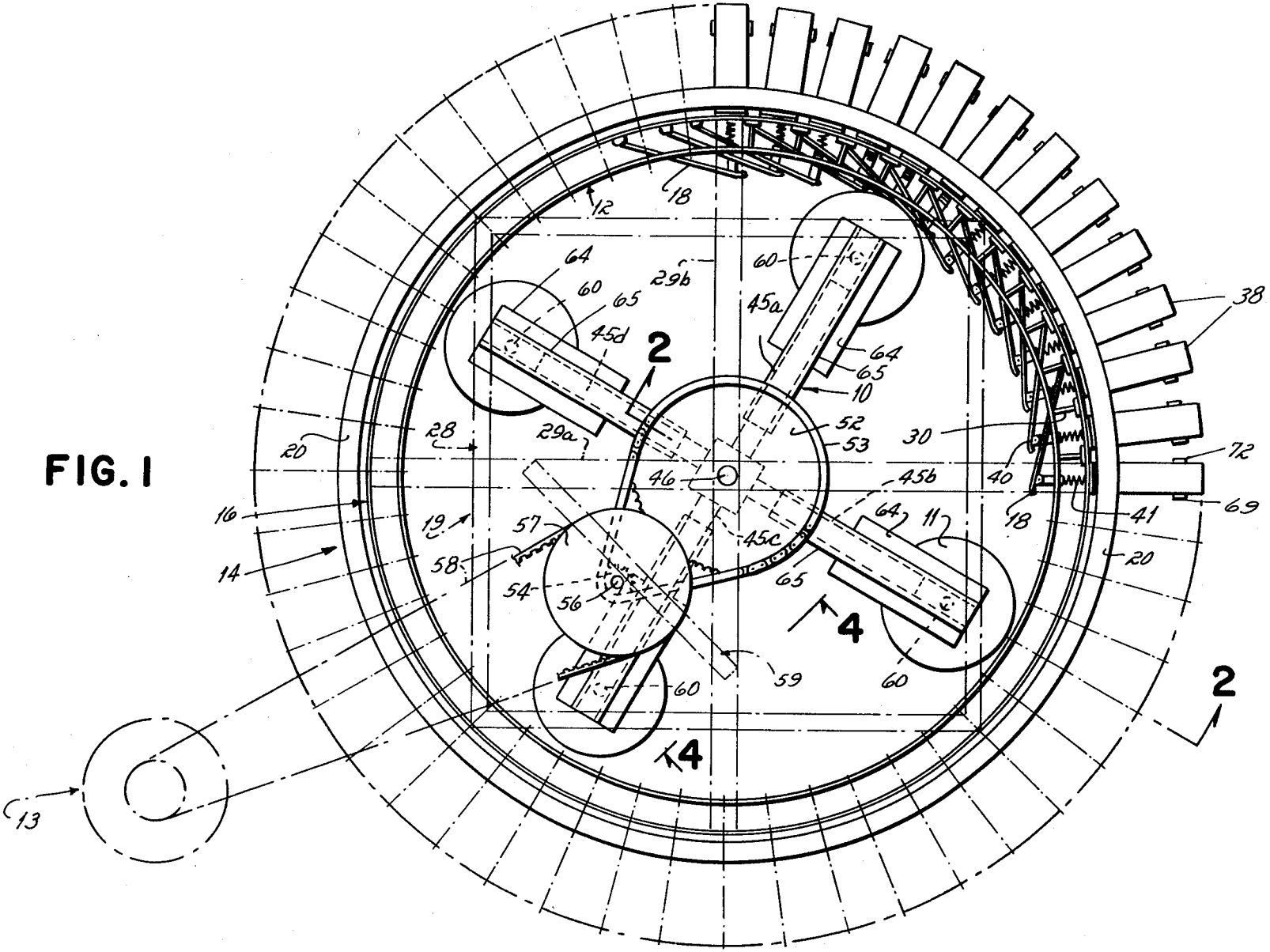
FIG. 1 is a plan view of an embodiment of a rotary pump made in accordance with the teachings of this invention.
Figure 2:
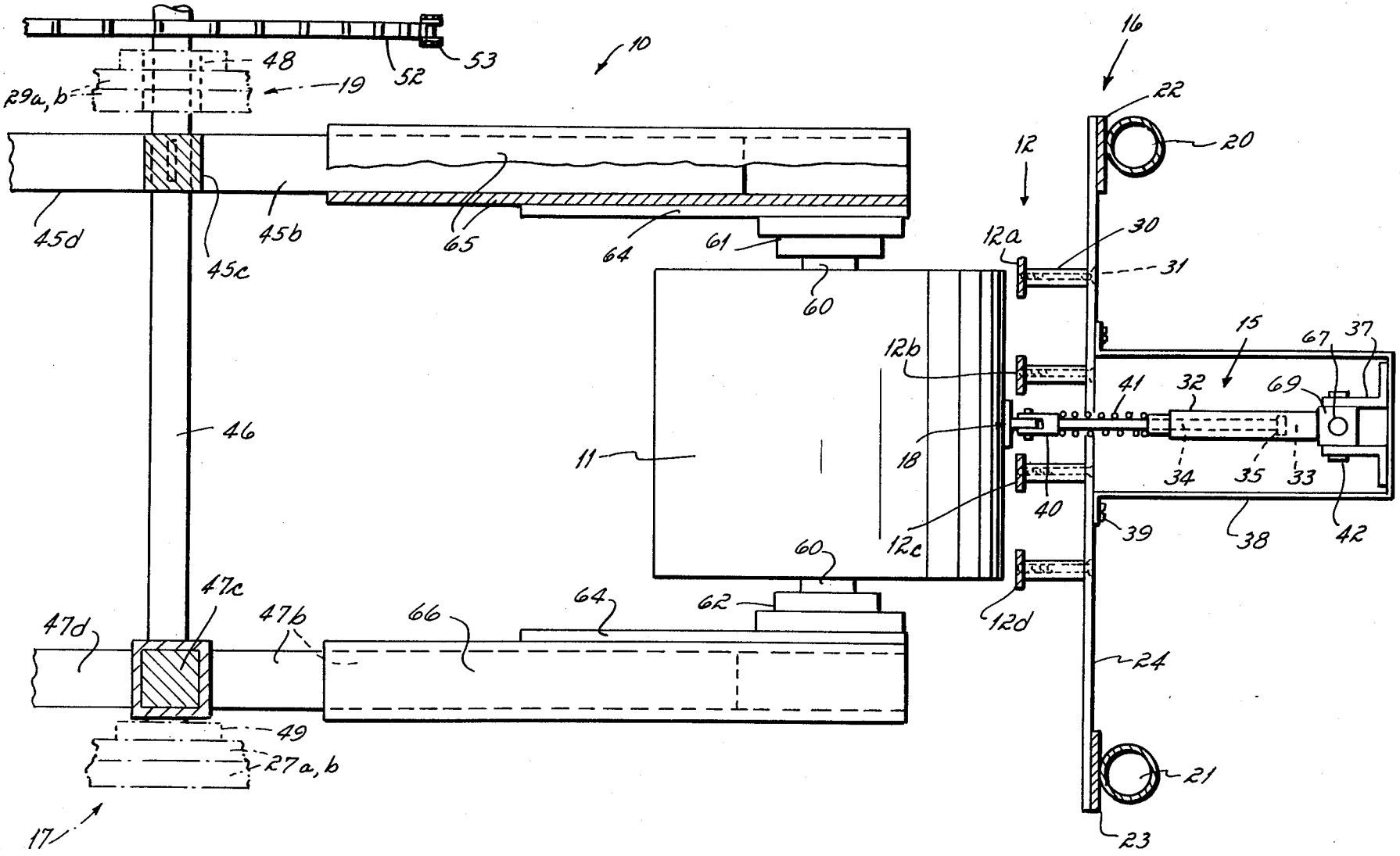
FIG. 2 is a cross-sectional view taken along line 2—2 of FIG. 1.

With specific reference to FIGS. 1 and 2, this invention in a rotary pump has as its main components an X-shaped rotatable frame 10 which carries rotatably mounted rollers 11 for movement along a circular track generally designated by the numeral 12. The frame 10 is rotated in a conventional manner, as by the use of a drive motor 13 and an associated drive transmission. A casing assembly 14 has a plurality of pumps 15 mounted thereon. In this embodiment, the casing 14 is concentric with the circular track 12 and spaced outwardly therefrom, with the pumps 15 radiating from the casing in a regular pattern around the casing.

Lever arms 18 are pivoted at one end to casing 14 and have a free end which extends within the radius of the track 12 and into the path of the rollers 11. The lever arms 18 communicate with the pumps 15 such that, as the rollers 11 are moved along the track by the rotating frame 10, the lever arms 18 are depressed in succession to drive the pumps 15 for pumping and/or compressing of a fluid medium. Most significantly, the rollers 11 are mounted on the frame 10 so as to move radially with respect to the track 12 and lever arms 18 (or conversely, the hub of the frame 10). This gives the rotary pump of this invention a significant improvement in operating efficiency, since inertial forces present in the orbiting rollers 11 can be directly utilized in depressing the lever arms 18.

It will be noted that the inertial forces associated with the angular acceleration of the rollers 11 is colloquially referred to as centrifugal force. Centrifugal force is actually a fictitious force which arises only in an effort to describe the apparent force acting on an orbiting body, such as the rollers 11, viewed from a non-inertial reference frame, i.e., from a position on the frame 10. As used throughout this application, reference to such an inertial force or centrifugal force will be considered to be synonymous.

The Rotary Pump

The rotary pump of this invention has a casing assembly 14 generally comprising a cage 16, an upper frame support structure 19 and lower frame support structure 17. In this embodiment the cage 16 is utilized to support the various pumps 15, the track generally designated by the numeral 12, and the lever arms 18. Fluid supply manifold 20 and fluid exhaust manifold 21, along with their respective fluid conduits communicating with the pump cylinders 15, are also advantageously carried on the casing cage 16.

In this embodiment of the invention, the pump will be described as specifically adapted for the pumping of a liquid medium, such as water. It will, of course, be recognized that the invention is not so limited, since it could easily be adapted to pump and compress a gas, such as air.

Figure 3:
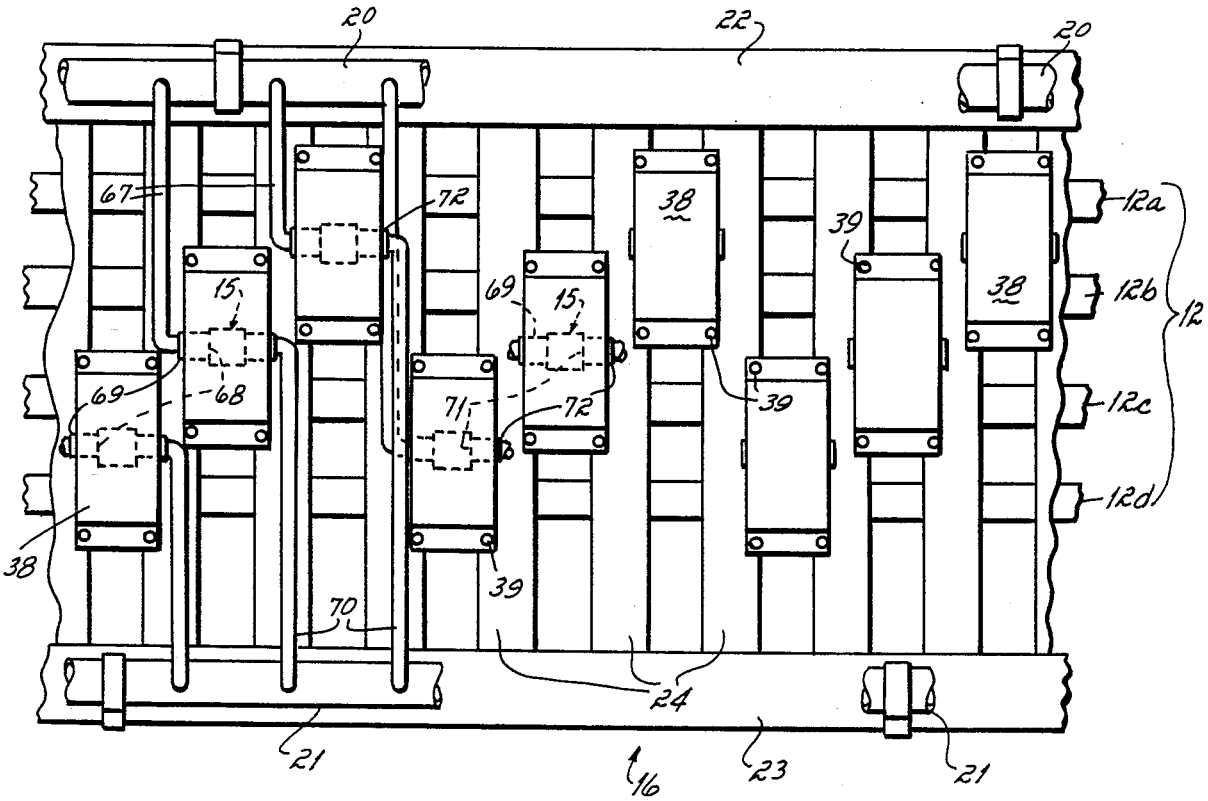
FIG. 3 is an elevational view detailing an arrangement of fluid conduits and pumps around the pump casing.

The cage 16 has been advantageously formed as a short open cylinder. With reference to FIG. 3, the cage 16 is composed of an upper circular band 22, a lower circular band 23, and interconnecting vertical struts 24. All of the elements 22–24 making up the cage 16 in this embodiment are advantageously made of mild steel, with the various elements rivoted or bolted one to another. A cylindrical shaped cage 16 is thus constructed.

As previously stated, the casing 14 has upper and lower frame support structures 17, 19. Each frame support structure comprises a rectangular-shaped brace member 28 and a crucifix comprising arms 29*a* and 29*b* which extend across perpendicular diameters of the cage 16. Cross-frame portions 29*a* and 29*b* are fixed to the rectangular base member 28 as by bolting at the overlapping portions. The corners of frame 28 and the ends of arms 29*a*, 29*b* are secured, as by welding for example, to the upper band 22 of the cage 16. The intersection of cross-frame portions 29*a* and 29*b* is on the axis of cage 16, which also forms the axis of the pump itself in this embodiment. Lower support structure 17 has a crucifix comprising arms 27*a* and 27*b* which also extend across perpendicular diameters of the cage 16 and are fixed to the bottom of lower band 23.

Mounted inwardly and concentric with the cage 16 is the track, generally designated by the numeral 12. The circular track in this preferred form of the invention is comprised of a plurality of vertically spaced track portions 12*a–d*, as more clearly shown in FIGS. 2 & 3. These circular track portions are formed of bands of cold rolled, mild steel. The individual track portions are supported by the cage 16 and spaced inwardly therefrom by track support segments 30, which are lengths of steel pipe. Machine screws 31 extend along the axis of the pipe spacers 30 to attach the track and spacers to the cage 16, thus holding the track 12 and the spacers 30 in place. A generally circular track 12 of relatively constant radius is thus provided within the casing 14.

Radiating outwardly from the cage 16 of casing 14 are a plurality of pumps 15. The pumps 15, such as common Bimba-type pneumatic pumps having a 0.75 inch internal diameter and a 0.44 cubic inch displacement per inch of stroke (2 inch full stroke), have been effectively used herein at cylinder pressures between 200–300 psig. The pumps 15 generally comprise a cylinder body 32 having an interior pump chamber 33 and a reciprocating piston within the cylinder body 32 having a piston rod 34 and a piston head 35. The pumps 15 are each supported at one end in a mount 37, as by pivot connections 42. The mount 37 is fixed to a pump support frame 38, and the support frame 38 is fixed, as by screws or bolts 39, to the struts 24 of the cage 16. The pumps 15 are arranged in a regular spaced pattern around the cage 16. A staggered, somewhat sinusoidal pattern has been used in this embodiment (FIG. 3) for reasons which will be made clear hereafter.

A lever arm 18 is associated with each of the pumps 15. Each lever arm is pivotally fixed at one end to the cage 16, and is fixed at or near the other end to a respective end of a piston rod 34, as by pivot connection 40. Each lever arm 18 is biased radially inwardly with respect to the track 12, as by coil spring 41. In this form of the invention, each lever arm forms an oblique angle with the track 12. In order to accommodate a large number of pumps around the circumference of the casing 14 and relatively long lever arms presenting relatively gentle slopes, the lever arms 18 are shown mounted in a staggered pattern. The pumps are consequently also arranged in the same staggered pattern. In this embodiment of the invention, 48 pumps are mounted about a track having a diameter of around 4 feet. In FIG. 1, only one quadrant of these cylinders has been illustrated for purposes of clarity. It will be recognized that although a circular track 12 is described, an elliptical track might also be used to advantage.

The pressure-volume relationship for the pumps 15 can be adjusted in this rotary pump by changing the length of the stroke, which in turn can be done by varying the angle of the lever axis and the cylinder piston rod 34. This can be accomplished, for example, by moving the cylinders 32 radially inwardly or outwardly, thereby changing the angle of contact between the rollers 11 and the lever arms 18 and the distance through which the lever arms will be moved.

The lever arms 18 are successively depressed to operate the pumps 15 by rollers 11 which are rotatably carried on rotatable frame 10. Although one roller 11 might be used herein, a plurality of rollers is preferred. The rollers 11 are equiangularly spaced one from another on the frame, and may be two in number, four, as shown here, or more as is appropriate or desirable. The rollers 11 are fairly massive in this embodiment, each weighing approximately 150 pounds and formed from closed steel pipe sections filled with lead shot.

The frame 10 is of an X-shape in this embodiment, having upper arms 45*a–d* equiangularly spaced about and fixed to a central shaft 46. Lower arms 47*a–d* are likewise equiangularly spaced and fixed to the lower portion of the shaft 46. The arms are vertically spaced apart and extend substantially parallel to one another, e.g., arm 45*b* extends parallel to arm 47*b* (FIG. 2).

Central shaft 46 is mounted for rotatable movement. Its upper end extends through an aperture formed at the intersection of upper frame support portions 29*a* and 29*b* and through bearing sleeve 48, with the lower portion of the shaft set in a flanged pillow block bearing mount 49 which is in turn mounted on the lower frame support portions 27*a* and 27*b*.

Figure 4:
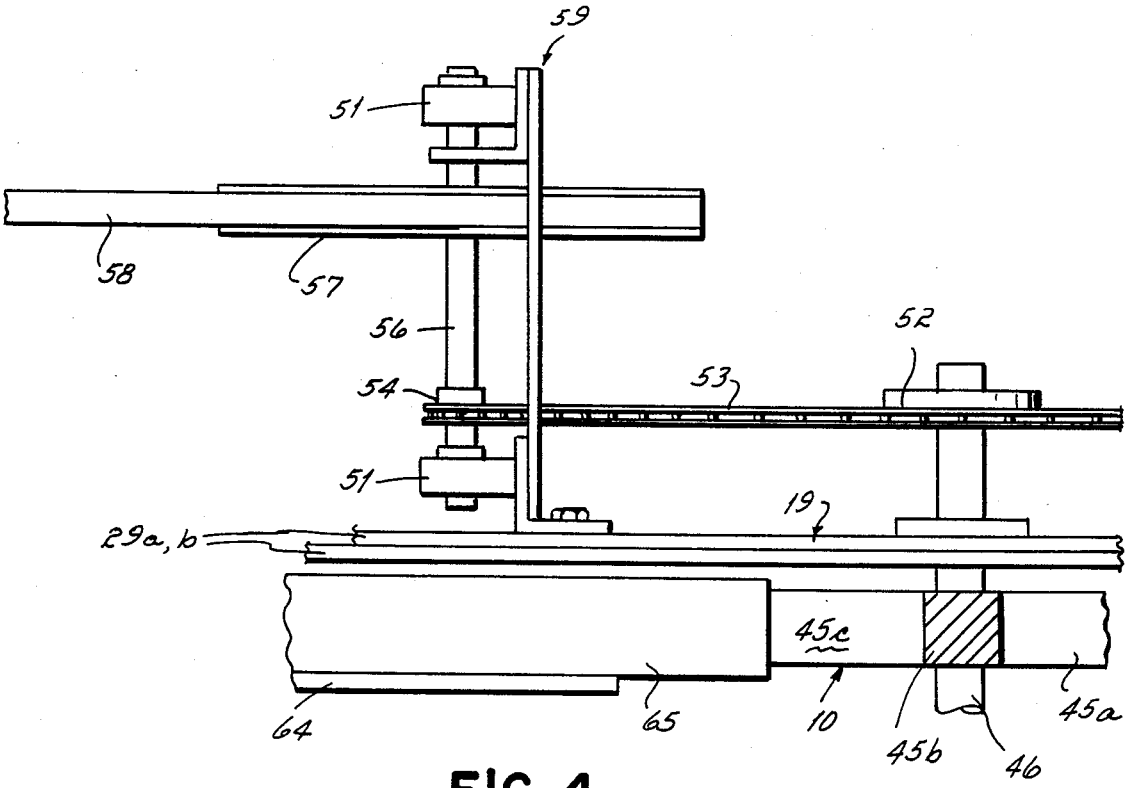
FIG. 4 is an elevational view taken along line 4—4 of FIG. 1.

With reference to FIGS. 1 and 4, the frame 10 is driven by rotating the drive shaft 46. To this end, a large diameter toothed sprocket 52 is fixed to the top of the shaft 46. The sprocket 52 is driven by a speed reducing assembly which includes a drive chain 53 which engages a small ten tooth sprocket 54 carried on short shaft 56. The shaft 56 mounts a gear driven by a timing belt 58, which in turn is driven by the drive motor 13. A $\frac{1}{4}$ horse power (8,250 ft. pounds) to $\frac{1}{2}$ horse power (16.500 ft. pounds) electric motor may be used for the drive motor 13 to advantage in this embodiment. A variable power drive can also be used.

Short shaft 56 is rotatably mounted in a vertical frame 59 which is fixed to the upper frame support portions 29*a* and 29*b*. Pillow block bearings 51 support the shaft 56 on the frame 59. The motor 13, when engaged, causes gear 57 to turn via timing belt 58, causing the short shaft 56 and reducing sprocket 54 to turn, thus driving the large sprocket 52 via the chain 53. Rotational speeds of between 30 to 45 rpm using hydraulic cylinders of the type described with a 1 inch stroke have been accomplished with this arrangement using a $\frac{1}{4}$ horse power electric motor operating at rated load.

As best shown in FIG. 2, the rollers 11 have an axial shaft 60 (or alternatively, two axial stub shafts at either end) which is carried in upper bearing 61 and lower bearing 62. A flanged pillow block bearing has been used for both the upper and lower bearing 61 and 62. Bearing 61 is fixed to a sleeve 65 which is slidable along arm 45*b*, for example. Bearing 62 is likewise fixed to a sleeve 66 which is in turn slidably received on arm 47*b*, for example. A like arrangement of bearings and slidable sleeves is provided for each roller 11. The sleeves 65, 66 are formed of a suitable material such as tubular steel pipe or the like, and may be provided with a bearing mounting plate 64.

The rollers 11 are thus free to move radially outwardly, as well as inwardly, by virtue of being mounted to the sleeves 65, 66 carried on the arms of the frame 10. Suitable lubricant may be applied to the inside of the sleeves 65, 66 to permit ready slidability.

The significance of providing rollers which are radially movable on a rotating frame should now be apparent. As the frame 10 is rotated, the rollers 11 will move radially outwardly into contact with the track 12. In so doing, as the rollers progress around the track (here in a clockwise fashion), each of the lever arms 18 will be depressed in succession by a given roller to drive the pistons of the pumps 15. The inertial component of the angular acceleration of the rollers can be directly tapped to depress the lever arms 18, since it is the lever arms collectively which continuously resist this inertial component of the roller motion. The overall efficiency of the rotary pump is thus improved by the direct utilization of these inertial forces.

It will be recognized that the rotary pump of this invention could be designed without a track, with the lever arms arranged to serve the same purpose. That is, a pump of the foregoing type could utilize a series of lever arms which form the radial boundary for the rollers rather than a separate track.

In this embodiment, the pumps 15 are used to pump a liquid, such as water. Water from a reservoir (not shown) flows into supply manifold 20 which here extends around the perimeter of the casing 14 adjacent the top thereof. A plurality of fluid supply lines 67 extend from supply manifold 20, one to an inlet 68 of each pump 15. A one way check valve 69, such as a Boston Gear check valve (Catalog Number J3320), is provided in the inlet 68 to permit fluid to enter into the pump 15 upon withdrawal of the piston head 35 and to prevent backflow into the supply manifold 20 when the piston is driven into the chamber 33. A fluid exhaust line 70 extends from each outlet 71 provided in the pump 15 and communicates with a fluid exhaust/collection manifold 21. A one-way check valve 72 is provided in each outlet 71 to permit fluid to flow through line 70 upon the compression stroke, and prevent fluid to be drawn through line 70 back into the chamber upon withdrawal of the piston head 35.

Although a small volume of liquid is pumped in the actuation of a single pump 15, the serial arrangement of a large number of pumps 15 can move a significant volume of liquid very efficiently. For example, the above described embodiment is projected to be able to move 7.6 gallons per minute when operated at 30 rpm with cylinder compression of 44 psig.

Thus, while the invention has been described in connection with a certain presently preferred embodiment, those skilled in the art will recognize many modifications of structure, arrangement, portions, elements, materials, and components which can be used in the practice of the invention without departing from the principles of this invention.

What is claimed is:

1. A piston pump utilizing orbiting means to operate the pistons, comprising:

rotary drive means including at least one roller rotatably carried on a rotatable frame for movement along an orbital path, and means to rotate the frame on a frame axis, a plurality of pumps each having a cylinder, a reciprocating piston, an inlet for admitting a fluid into the cylinder and an outlet for exhausting fluid from the cylinder, inlet conduit means for conveying a fluid from a fluid source to the inlets of the cylinders, and outlet conduit means for conveying fluid from the outlets of the cylinders, a plurality of pivotable lever arms connected to drive the respective pistons in their cylinders, and means biasing the lever arms away from the cylinders and into said orbital path for engagement of the lever arms by the roller as it moves along said orbital path, a casing mounting the pumps and the lever arms adjacent said orbital path, each roller being carried between sleeves slidably received on a pair of spaced parallel arms radiating from a hub on the frame axis for transverse movement of the roller with respect to said orbital path to thereby utilize the inertial force of the orbiting roller while engaging the lever arms to drive the lever arms.

2. The pump of claim 1 further including a circular track within the casing over which the at least one roller runs, the track comprising a plurality of concentric, spaced apart circular track portions, the lever arms extending between the track portions in staggered fashion.

3. The pump of claim 2 wherein each lever arm is fixed at one end to the casing, the other end extending within the radius of the track at an oblique angle thereto such that a roller rotated by the frame passes up the incline formed by each lever arm thereby causing each arm in turn to be driven toward the track and radially outwardly to drive a piston rod and cause the piston to move within its respective cylinder to pump fluid.

4. A fluid pump comprising, a circular track within a casing, a plurality of pumps radiating from the casing, the pumps each including a cylinder having a chamber, a piston head movable in the cylinder, a piston rod connected to the piston head, an inlet for admitting fluid into the chamber, an outlet for exhausting fluid from the chamber, and inlet and outlet check valves, a lever arm connected to each piston rod, each lever arm extending at least in part within the radius of the circular track, each lever arm including means to bias the lever arm radially inwardly to the track, conduit means for conveying a fluid from a reservoir to the inlet of each cylinder chamber, and outlet conduit means for conveying fluid from the outlet of each cylinder chamber, a rotary drive member within the casing for successively moving the lever arms to drive the pumps, the rotary drive member including a frame mounted for rotary movement within the casing and track, the frame having a central hub and pairs of opposed arms radiating therefrom, at least a pair of rollers equiangularly spaced apart and rotatably carried by the frame for travel along the circular track, each roller being mounted to sleeves freely slidable on opposed arms such that each roller can move radially inwardly and outwardly in relation to the track, and drive means for rotating the rotary drive member.

5. The pump of claim 4 wherein the track comprises a plurality of spaced circular track portions, with the lever arms extending between the track portions.

6. The pump of claim 5 wherein the rotary drive member has two pair of rollers, the four rollers being equiangularly spaced apart.

7. The pump of claim 5 wherein the track portions are supported on the casing, and wherein each lever arm is fixed at one end to the casing, the other end extending within the radius of the track at an oblique angle thereto such that a roller rotated by the frame passes up the incline formed by each lever arm thereby causing each lever arm in turn to be driven toward the track and radially outwardly which in turn drives a piston rod and causes the piston head to move within the cylinder to pump fluid.

8. The pump of claim 7 wherein the inlet conduit means comprises a manifold, an inlet pipe from the manifold to each of the inlets of the cylinder chambers, and further including an outlet conduit for conveying fluid exhausted from the chambers, the outlet conduit comprising an outlet manifold, and an outlet pipe extending from each of the outlets of the chambers in fluid communication with the outlet manifold.

9. A piston pump utilizing orbiting means to operate the pistons, comprising:

a plurality of pumps, each pump having a cylinder, a reciprocable piston, an inlet for admitting a fluid into the cylinder, and an outlet for exhausting fluid from the cylinder, inlet conduit means for conveying a fluid from a fluid source to the inlets of the cylinders, and outlet conduit means for conveying fluid from the outlets of the cylinders, a plurality of pivotable lever arms connected to drive the respective pistons, the lever arms extending angularly within the radius of a circular orbital path, and means biasing the lever arms away from the cylinders, rotary drive means for rolling over the lever arms to operate the pistons, the rotary drive means including at least one massive roller rotatably carried on a rotatable frame for movement around said orbital path, means mounting said roller to the frame permitting the roller to move radially with respect to the orbital path, and means to rotate the frame, the frame when rotated conveying the roller around the orbital path intersecting the lever arms in succession to operate the pistons in the cylinders, each roller being carried between sleeves slidably received on a pair of spaced parallel arms extending from the frame for transverse movement of the roller with respect to said orbital path to thereby utilize the inertia of the orbiting roller while engaging the lever arms to drive the lever arms.

* * * * *